US007976219B2

(12) United States Patent
Bois et al.

(10) Patent No.: US 7,976,219 B2
(45) Date of Patent: Jul. 12, 2011

(54) CLOSING DEVICE WITH SLIDER FOR SACHET, COMPRISING ANTI-ENGAGEMENT MEANS

(75) Inventors: Henri Bois, Neuilly sur Seine (FR); Antony Roger, Sartrouville (FR)

(73) Assignee: S2F Flexico, Henonville (FR)

( * ) Notice: Subject to any disclaimer, the term of this patent is extended or adjusted under 35 U.S.C. 154(b) by 1020 days.

(21) Appl. No.: 11/823,705

(22) Filed: Jun. 26, 2007

(65) Prior Publication Data

US 2008/0069483 A1 Mar. 20, 2008

(30) Foreign Application Priority Data

Jun. 29, 2006 (FR) ..... 06 05873

(51) Int. Cl.
*B65D 33/16* (2006.01)
*A44B 1/04* (2006.01)
*A44B 19/00* (2006.01)

(52) U.S. Cl. ..... 383/64; 24/399; 24/585.12

(58) Field of Classification Search ..... 383/64; 24/399, 400, 585.12
See application file for complete search history.

(56) References Cited

U.S. PATENT DOCUMENTS

| | | | | |
|---|---|---|---|---|
| 3,426,396 | A | 2/1969 | Laguerre | |
| 6,611,998 | B1 | 9/2003 | Stiglic | |
| 6,691,375 | B1 | 2/2004 | Savicki | |
| 6,786,641 | B2 * | 9/2004 | Plourde | 383/64 |
| 7,097,359 | B2 * | 8/2006 | Plourde et al. | 383/63 |
| 7,416,338 | B2 * | 8/2008 | Ausnit | 383/64 |
| 7,461,434 | B2 * | 12/2008 | Ackerman | 24/30.5 R |
| 7,574,782 | B2 * | 8/2009 | Ackerman | 24/400 |
| 2005/0041892 | A1 | 2/2005 | Stolmeier | |

FOREIGN PATENT DOCUMENTS

| | | | |
|---|---|---|---|
| EP | 0004707 | | 10/1979 |
| EP | 1153552 | | 11/2001 |
| EP | 1447338 | | 8/2004 |
| JP | 08214920 | A * | 8/1996 |
| JP | 2000152810 | A * | 6/2000 |

* cited by examiner

*Primary Examiner* — Jes F Pascua

(74) *Attorney, Agent, or Firm* — Blakely, Sokoloff, Taylor & Zafman

(57) ABSTRACT

The present invention relates to a closing device for sachets comprising at least two complementary closing elements (200, 300) and an associated slider (100) comprising a central bead (140), adapted for modifying the joining state of said two elements (200, 300) so as to respectively separate or engage the latter according to its direction of motion, characterized in that the slider (100) comprises at least one flexible lip (145, 146) placed on the apex of the central bead (140) opposite a lead angle (216, 316) provided on the closing element (200, 300), according to a configuration such that any attempt to pull back the slider results in autolocking hanging of the lip (145, 146).

17 Claims, 2 Drawing Sheets

CLOSING DEVICE WITH SLIDER FOR SACHET, COMPRISING ANTI-ENGAGEMENT MEANS

TECHNICAL FIELD

The present invention relates to the field of reclosable sachets comprising at their outlet closing devices known for allowing successive multi-openings/closures, as required.

More precisely, the present invention relates to closing devices actuated via a slider.

BACKGROUND

Numerous closing devices for sachets have already been put forward.

The majority of these devices is formed on the basis of complementary male/female profiles, or even hooks or hook and loop fastener-type devices such as those sold under the trademark VELCRO.

Numerous slider structures for controlling such closing devices have also been proposed.

The aim of the present invention is to propose novel closing devices with a slider having properties superior to those of known devices.

More precisely, the aim of the present invention is to propose means limiting the risk of the sliders being torn off.

Different attempts have been made for this purpose. However, none of them provides total satisfaction.

The documents US 2005/041892, EP 1153552, EP 1447338 and U.S. Pat. No. 3,426,396 for example describe rigid structures on sliders, intended to be rest on complementary elements provided on the closing devices.

The documents U.S. Pat. No. 6,611,998 and U.S. Pat. No. 6,691,375 describe a solution consisting of placing, on the inner surfaces of the lateral flanges of the sliders flexible lips intended to cooperate with complementary elements provided on the closing devices. The drawback to this solution is forcing the lateral flanges apart when the closing devices stress said flexible lips.

The above aim is achieved within the framework of the present invention due to a closing device for a sachet comprising at least two complementary closing elements and an associated slider comprising a central bead, adapted to modify the joining state of said two elements by respectively separating or engaging the latter according to its direction of motion, characterized in that the slider comprises at least one flexible lip placed on the apex of the central bead opposite a lead angle provided on a closing element, according to a configuration such that any attempt to withdraw the slider results in autolocking hanging of the lip.

"Autolocking hanging" of the lip is understood to mean any reinforcing of the effort exerted on the flexible lip by the lead angle opposite the closing element, tending to reinforce locking of said flexible lip against said lead angle.

As will also be understood within the scope of the present invention since the flexible lip is carried by the apex of the central bead of the slider and not by a lateral flange of the latter, the thrust exerted on the flexible lip is distributed over the central bead and not on the lateral flanges of the slider.

The present invention also concerns sachets equipped with such a closing device.

BRIEF DESCRIPTION OF THE DRAWINGS

Other characteristics, aims and advantages of the present invention will emerge from the following detailed description, and by means of the attached diagrams, given by way of non-limiting examples and in which.

DETAILED DESCRIPTION

Figure 1:
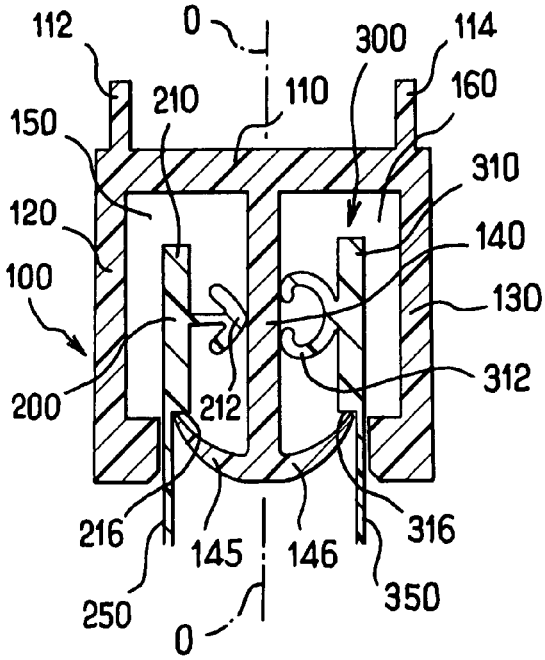
FIG. 1 illustrates a transversal sectional view of a closing device according to the present invention according to a first cutting plane of the slider passing through two separate channels maintaining closure profiles in the separated position.

A slider 100 of general classical structure is evident in FIG. 1.

This slider 100 comprises a base 110, two lateral flanges 10, 120, 130 and a central bead 140.

Figure 2:
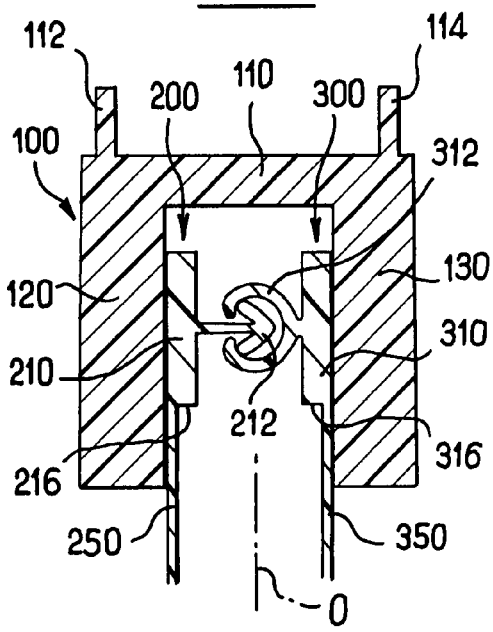
FIG. 2 illustrates a sectional view of the same device according to a second cutting plane parallel to that of FIG. 1, at the level of which the two channels are joined to enable the closing profiles to be engaged.

The lateral flanges 120, 130 and the central bead 140 define in combination two channels 150, 160, in part at least not parallel. These channels 150, 160 join at one end of the slider 100, as in FIG. 2. The channels 150, 160 join together the closing elements 200, 300, respectively. The specialist understands that as it is moved the slider 100, according to the direction of motion, separates the closing profiles 200, 300, as shown in FIG. 1, or on the contrary carries the latter engaged, as shown in FIG. 2.

The attached figures illustrate two closing elements 200, 300 extruded onto films 250, 350, constituting the sachet proper. As a variant, and in a manner known per se, the closing elements 200, 300 could be made initially separately, then connected and fixed onto the films 250, 350 by any appropriate means, for example by thermal welding.

According to the embodiments illustrated in the attached figures, the two closing elements 200, 300 comprise support bulges 210, 310, each of which carries a closing element as such 212, 312 respectively of complementary male and female type. By way of variant, such elements 212, 312 could be replaced by any equivalent means, for example structures with hooks or complementary hook and loop fastener type such as those sold under the trademark VELCRO.

As mentioned earlier, according to the present invention the slider 100 comprises, on the apex of the slider 100 opposite the base 110, at least one flexible lip 145, 146 placed opposite a lead angle 216, 316 provided on a closing element 200, 300, according to a configuration, such that any attempt to pull back the slider 100 results in autolocking hanging of the lip 145, 146. More precisely again, preferably within the scope of the present invention, the closing device comprises two lips 145, 146 cooperating respectively with a lead angle 216, 316 provided on each of the two elements 200, 300.

The lead angles 216, 316 are provided on the inner face of the closing elements 200, 300. The lips 145, 146 are oriented towards the base 110 by moving away from a plane of symmetry 0-0 parallel to the direction of translation of the slider and passing through the plane of symmetry of the central bead 140.

Figure 3:
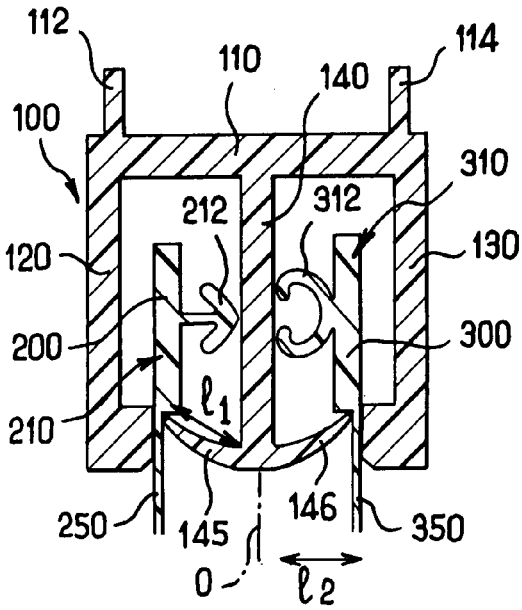
FIG. 3 illustrates a view similar to FIG. 1 simulating an attempt to pull back the slider.

FIG. 3 shows that if the attempt is made to pull back the slider 100, the lead angles 216, 316 stress the lips 145, 146. The lips 145, 146 then are underpinned and deformed, their apex being brought closer to the lateral flanges 120, 130 (moving away from the base 110 by deformation accompanied by a pivoting movement about the zone connecting the lips 145, 146 at the apex of the central bead 140). This ends in autolocking, where the closing elements or the films 250, 350 are wedged between the apex of the lips 145, 146 and the flanges 120, 130. The specialist will understand that simultaneously this produces a seal between the two film elements 250, 350 inside the slider 100.

The height of the lips 145, 146, illustrated under reference e1 in FIG. 3, is preferably greater than a width e2, illustrated in the same FIG. 3, of the free opening formed between the apex of the central bead 140 and the free end of the flanges 120, 130. Consequently, owing to this arrangement, it is guaranteed that during an attempt to pull back the slider 100 the apex of the lips 145, 146 rests against the films 250, 350.

In the case as shown in FIGS. 1 to 3, the lateral flanges 120, 130 have a flared sole plate 121, 131 at their free end, more precisely, the lips 145, 146 are stressed against the flanks of these sole plates 121, 131 during an attempt to pull back the slider 100.

Figure 4:
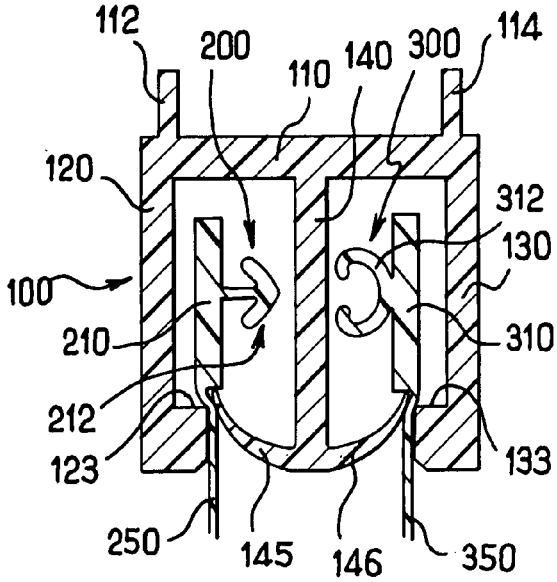
FIG. 4 illustrates a sectional view similar to a second embodiment of the closing device according to the present invention.

FIG. 4 illustrates a variant embodiment according to which the lips 145, 146 have a length even greater, such that their apexes do not rest against the flanks of the sole plates 121, 131 but against lead angles 123, 133 formed between the flanks of the sole plates 121, 131 and the flanges 120, 130, and directed towards the base 110. The specialist will understand that this arrangement further reinforces the locking effect on the underpinned lips 145, 146, at the same time limiting the stress by separating the lateral flanges 120, 130.

Figure 5:
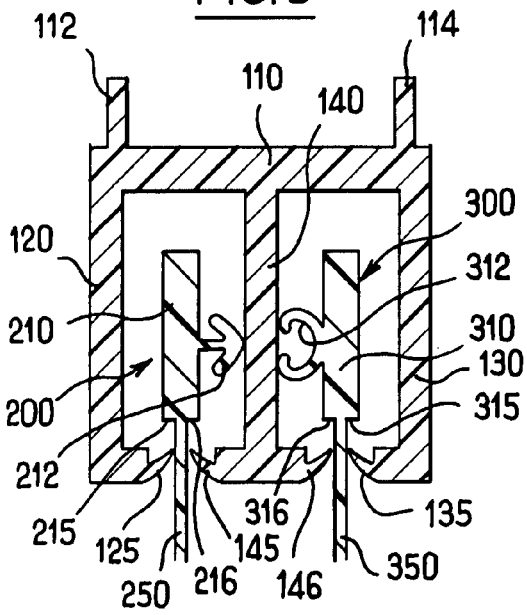
FIGS. 5, 6, 7 and 8 illustrate views similar to FIG. 1 in transversal section of four other variant embodiments of closing devices according to the present invention.

FIG. 5 shows another variant embodiment according to which it is provided with lips 125, 135, 145, 146 simultaneously on the lateral flanges 120, 130 and on the central bead 140. These lips 125, 135 and 145, 146 cooperate with lead angles 215, 315, 216, 316 provided respectively on the outer faces and on the inner faces 20 of the bulges 210, 310 of the closing elements.

According to the embodiment shown in FIG. 5, the lips above 125, 135 and 145, 146 are situated substantially on the same level and have substantially identical lengths and suppleness. So their apexes come into mutual contact on either side of the films 250, 350 when the slider 100 is stressed or pulled back.

Figure 6:
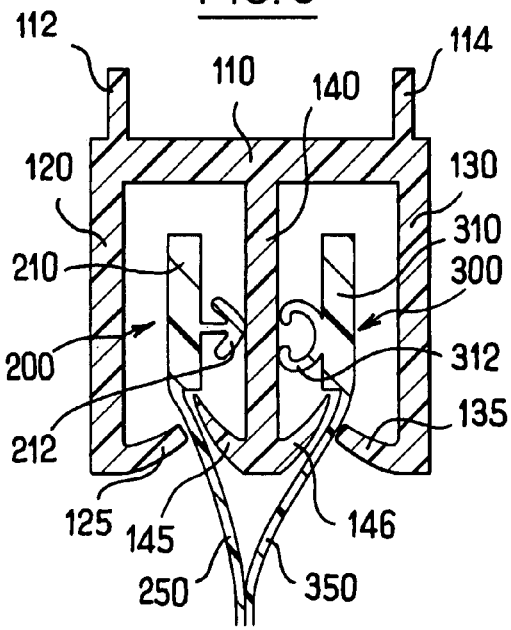
Figure 7:
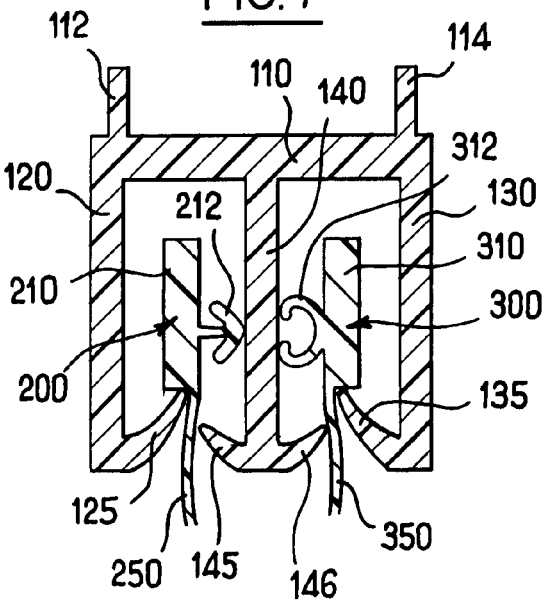

On the contrary FIGS. 6 and 7 show pairs of lips 125, 135 and 145, 146, respectively, having different lengths.

According to the embodiment shown in FIG. 6, the longest lips 145, 146 are solid with the central bead 140.

Conversely, according to the embodiment shown in FIG. 7, the longest lips 125, 135 are solid with the inner faces of the lateral flanges 120, 130

In the two cases of the embodiments illustrated in FIGS. 6 and 7, the longest lips are placed on the interior of the slider relative to the shortest lips.

The specialist will understand that in this case, the outer face of the longest lips comes into contact with the apex of the shortest lips during an attempt to pull back the slider.

Figure 8:
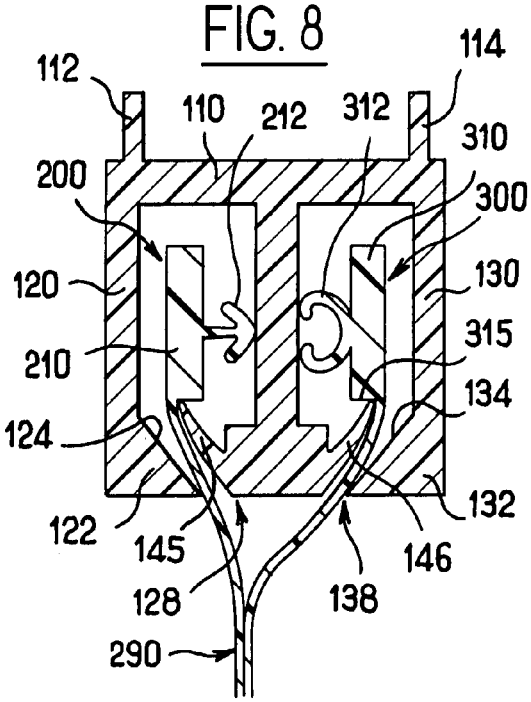

FIG. 8 shows another variant embodiment according to which the lateral flanges 120, 130 are fitted, in the vicinity of their free end opposite the base 110, and on their inner face, with substantially rigid flanges 122, 132. These flanges 122, 132 each define an inclined facet 124, 134 forming a ramp which converges towards the plane symmetry 0-0 by moving away from the base 110. Two lips 145, 146 solid with the end free of the central bead 140 opposite the base 110 are placed on the interior of these ramps 124, 134. The lips 144, 146 converge towards the base 100 by moving away from the plane of symmetry 0-0.

The ramps 124, 134 define in combination with the lips 145, 146 channels 128, 138 which converge by moving away from the base 110.

The specialist will comprehend from studying FIG. 8 that the channels 128, 138 cause the films 250, 350 to approach one another and ensure contact between the latter at the level of a zone referenced 290 in FIG. 8. Such a structure obviously improves the sealing property of the device.

In addition, the specialist will comprehend that this sealing is further reinforced when an attempt is made to pull back the slider, with the lips 145, 146 30 tending to accentuate the effort and convergence of the films 250, 350.

Scrutiny of the attached figures will clarify that the slider 100 is preferably fitted on the outer face of the base 110 with two tappets or lugs 112, 114 substantially adjacent to the flanges 120, 130. In a manner known per se, such tappets 112, 114, when they are caused to approach one another, stress the flanges 120, 130 to move apart and consequently accentuate the width of opening of the channels 150, 160 to facilitate engagement of a slider on the closing elements 210, 220.

The lips 125, 135, 145, 146 can be made from the same material as the essential material of the slider 100, or from a different material. They are preferably made from a supple material such as polyethylene or ethylene copolymer.

It is understood that the present invention is not limited to the particular embodiments described hereinabove but extends to any variant in keeping with its basic idea.

We claim:

1. A closing device for sachets comprising at least two complementary closing elements (200, 300) and an associated slider (100) comprising a central bead (140), adapted to modify the joining state of said two elements (200, 300) so as to respectively separate or engage the latter according to its direction of motion, characterised in that the slider (100) comprises at least one flexible lip (145, 146) placed on the apex of the central bead (140) opposite a lead angle (216, 316) provided on the closing element (200, 300), according to a configuration such that any attempt to pull back the slider results in autolocking hanging of the lip (145, 146).

2. The device as claimed in claim 1, characterised in that it comprises at least one lip (125, 135) on a lateral flange (120, 130) of the slider (100) and at least one lip (145, 146) on the apex of a central bead (140) of the slider.

3. The device as claimed in claim 2, characterised in that the lips (125, 135, 145, 146) are adapted to come into mutual contact at the level of their apex.

4. The device as claimed in claim 2, characterised in that one of the pairs of lips (125, 135, 145, 146) has a length greater than the other.

5. The device as claimed in claim 4, characterised in that the longest lips are solid with the central bead (140) of the slider.

6. The device as claimed in claim 4, characterised in that the longest lips are solid with the lateral flanges (120, 130) of the slider.

7. The device as claimed in claim 4, characterised in that the longest lips (125, 135, 145, 146) are placed on the interior of the slider.

8. A device as claimed in claim 1, characterized in that the central bead (140) presents a plane of symmetry parallel to the direction of translation of the slider (100).

9. The device as claimed in claim 8, characterised in that the lip (145, 146) converges towards abuse (110) of the slider by moving away from a plane of symmetry (O-O) parallel to the direction of translation of the slider and passing through the plane of symmetry of the central bead (140).

10. The device as claimed in claim 9, characterised in that the slider (100) comprises two symmetrical lips (145, 146) on the apex of the central bead (140).

11. The device as claimed in claim 9, characterised in that it also comprises a lateral flange (120, 130) defining in combination with the central bead (140) two opening channels (150, 160) defining for each part of the lateral flange (120, 130) an inner face opposite to the central bead (140), and comprises also at least one extra lip (125, 135), on the inner face of the lateral flange (120, 130).

12. The device as claimed in claim 11, characterised in that the extra lip (125, 135) converges towards a base of the slider 25 (110) by moving towards the plane of symmetry (O-O).

13. The device as claimed in claim 11, characterised in that the height (a) of the lips (125, 135, 145, 146) is greater than the width of the opening channels (150, 160) formed on the slider.

14. The device as claimed in claim 13, characterised in that the lips (145, 146) provided on the apex of the central bead (140) are adapted to be supported against a lead angle (123, 133) formed on the end of the lateral flanges (120, 130).

15. The device as claimed in claim 11, characterised in that the slider (100) comprises on the inner face of the free end of these lateral flanges (120, 130) flanges (122, 132) which define ramps converging towards the plane of symmetry (O-O) to define, in combination with lips (145, 146) solid with the apex of the central bead (140) of the slider, channels (128, 138) which converge by moving away from the base (110) of the slider.

16. The device as claimed in claim 11, characterised in that the lips (125, 135, 145, 146) are made of polyethylene or ethylene copolymer.

17. A sachet characterised in that it is fitted with a closing device as claimed in any one of claims 1 to 16.

* * * * *